US006607051B1

(12) United States Patent
Peng

(10) Patent No.: US 6,607,051 B1
(45) Date of Patent: Aug. 19, 2003

(54) YOKE STRUCTURE OF A SPEAKER DIAPHRAGM

(75) Inventor: Jack Peng, Chung Li (TW)

(73) Assignee: Meiloon Industrial Co., Ltd., Taipei (TW)

( * ) Notice: Subject to any disclaimer, the term of this patent is extended or adjusted under 35 U.S.C. 154(b) by 0 days.

(21) Appl. No.: 09/679,534

(22) Filed: Oct. 6, 2000

(51) Int. Cl.[7] ..... G10K 13/00
(52) U.S. Cl. ..... 181/171; 181/172
(58) Field of Search ..... 181/171, 172, 181/167, 169, 173; 381/396, 398, 413, 423, 424, 426, 428, 432

(56) References Cited

U.S. PATENT DOCUMENTS 2,439,666 A * 4/1948 Marquis ..... 181/171
2,490,466 A * 12/1949 Olson et al. ..... 181/171
3,019,849 A * 2/1962 King ..... 181/171

* cited by examiner

*Primary Examiner*—Khanh Dang
(74) *Attorney, Agent, or Firm*—Troxel Law Office PLLC

(57) ABSTRACT

A yoke structure of a speaker diaphragm comprises a casing having a front side being installed with an enlarged opening and rear side thereof being installed with a magnetic element; a coil being placed in the magnetic element; a damper being engaged with the coil; and a diaphragm being placed at the enlarged opening of the casing and being sticky to the coil, and a diaphragm being placed at the enlarged opening of the casing and being sticky to the coil. In the present invention, a yoke portion with two layer curved portions is placed between the casing and the diaphragm; the yoke portion is made of elastic material and has front and a rear layer, and each layer is formed with bent arcs. As a result, the diaphragm can be assembled conveniently at one time and is adhered well. Moreover, the center thereof can be positioned preferably. Thus, the output of the speaker will avoid interference from the vibration of the diaphragm. Therefore, the work of the yoke portion and the sound wave are more harmonic and as a result, a better sound quality is acquired.

2 Claims, 5 Drawing Sheets

YOKE STRUCTURE OF A SPEAKER DIAPHRAGM

FIELD OF THE INVENTION

The present invention relates to a yoke structure of a speaker diaphragm, and especially to yoke in a speaker which can be assembled conveniently. The diaphragm thereof is adaptive to the operation of the speaker. Moreover, the output of the speaker will avoid the interfere from the vibration of the diaphragm. Therefore, the work of the yoke portion and the sound wave are more harmonic and as a result, a better sound quality is acquired.

BACKGROUND OF THE INVENTION

A yoke portion is formed between the diaphragm of a speaker and the frame for supporting the periphery of the diaphragm and for isolating the air flow in the front and rear portion of the diaphragm so that the coil can be moved forwards and rearwards conveniently.

In the conventional speaker, a yoke portion is formed between the supporting frame and the diaphragm. Other than positioning the center of the diaphragm, by the arc design thereof, as the diaphragm moves, the yoke portion may telescopically move for assuring the speaker to emit voice correctly.

However, sound pressure of the speaker is positive proportional to the size of the diaphragm. The prior art yoke portion is exposed from the frame which has the following defects. The diameter of the supporting frame is equal to that of the diaphragm plus with the yoke portion. Therefore, the effective area for arranging a diaphragm is further smaller than the diameter of the supporting frame. Therefore, the output of the sound pressure is confined.

In order to improve the aforesaid defect, as shown in FIG. 1, a prior art design is developed, in which the surface of the diaphragm has no yoke portion, while the foaming pad under the enlarging opening of the supporting frame is connected to the lower portion of the diaphragm so that the sound pressure of the output of the speaker is increased effectively. The foaming pad can be used to replace the prior art yoke portion so as to assist the pull and push actions of the diaphragm so that the sound emitted from the speaker can be outputted normally.

However, in this design, the full opened diaphragm is connected to the foaming pad at the lower side. Other than the outermost edge of the diaphragm, no portion is confined by other elements. Therefore, it is possibly peeled after being used for a long time.

If it is to accurately and steadily position the center of the diaphragm, then another yoke portion must be added at the lower portion, i.e., a further assembly work is necessary. Besides, since an elastic foaming body is placed under the diaphragm, therefore, it is not good in cutting a magnetic field. As a force is applied thereon, it will compress due to the elasticity itself. Therefore, the harmonics of the output sound is effective.

Therefore, the prior art full opened diaphragm remains existing some defects needed to be improved.

SUMMARY OF THE INVENTION

Accordingly, the present invention provides a yoke structure of a speaker diaphragm, thereby, the output of the speaker will avoid the interfere from the vibration of the diaphragm. Therefore, the work of the yoke portion and the sound wave are more harmonic and as a result, a better sound quality is acquired without any distortion.

Another object of the present invention is to provide a yoke structure of a speaker diaphragm, wherein the folding edge of the top of the first curved portion is connected and enclosed by the end portion of the diaphragm, and thus, the diaphragm will not peel.

To achieve aforesaid object, the present invention provides a yoke structure of a speaker diaphragm comprising a casing having a front side being installed with an enlarged opening and rear side thereof being installed with a magnetic element; a coil being placed in the magnetic element; a damper being engaged with the coil; a diaphragm being placed at the enlarged opening of the casing and being sticky to the coil, and a diaphragm being placed in the inner side of the enlarging opening of the casing to be adhered to the coil. In the present invention, yoke portion with two layer curved portions is placed between the casing and the diaphragm; the yoke portion is made of elastic material and has a front and rear layer, and the upper and lower sides is formed with bent arcs. As a result, the diaphragm can be assembled conveniently at one time and is adhered well, Moreover, the center thereof can be positioned preferably. Thus, the output of the speaker will avoid interference from the vibration of the diaphragm. Therefore, the work of the yoke portion and the sound wave are more harmonic and as a result, a better sound quality is acquired.

The various objects and advantages of the present invention will be more readily understood from the following detailed description when read in conjunction with the appended drawings.

DETAILED DESCRIPTION OF THE PREFERRED EMBODIMENTS

Figure 1:
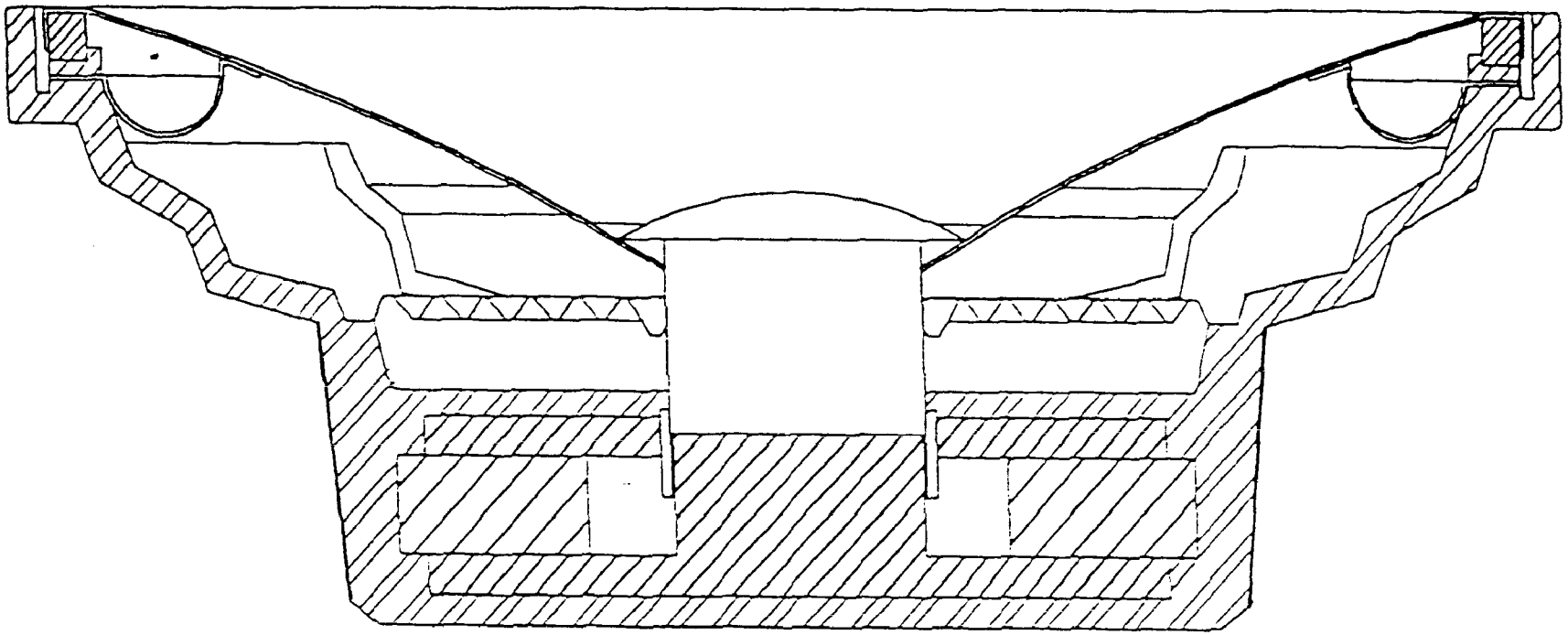
FIG. 1 PRIOR ART
FIG. 1 is a cross sectional view of a prior art speaker.
Figure 2:
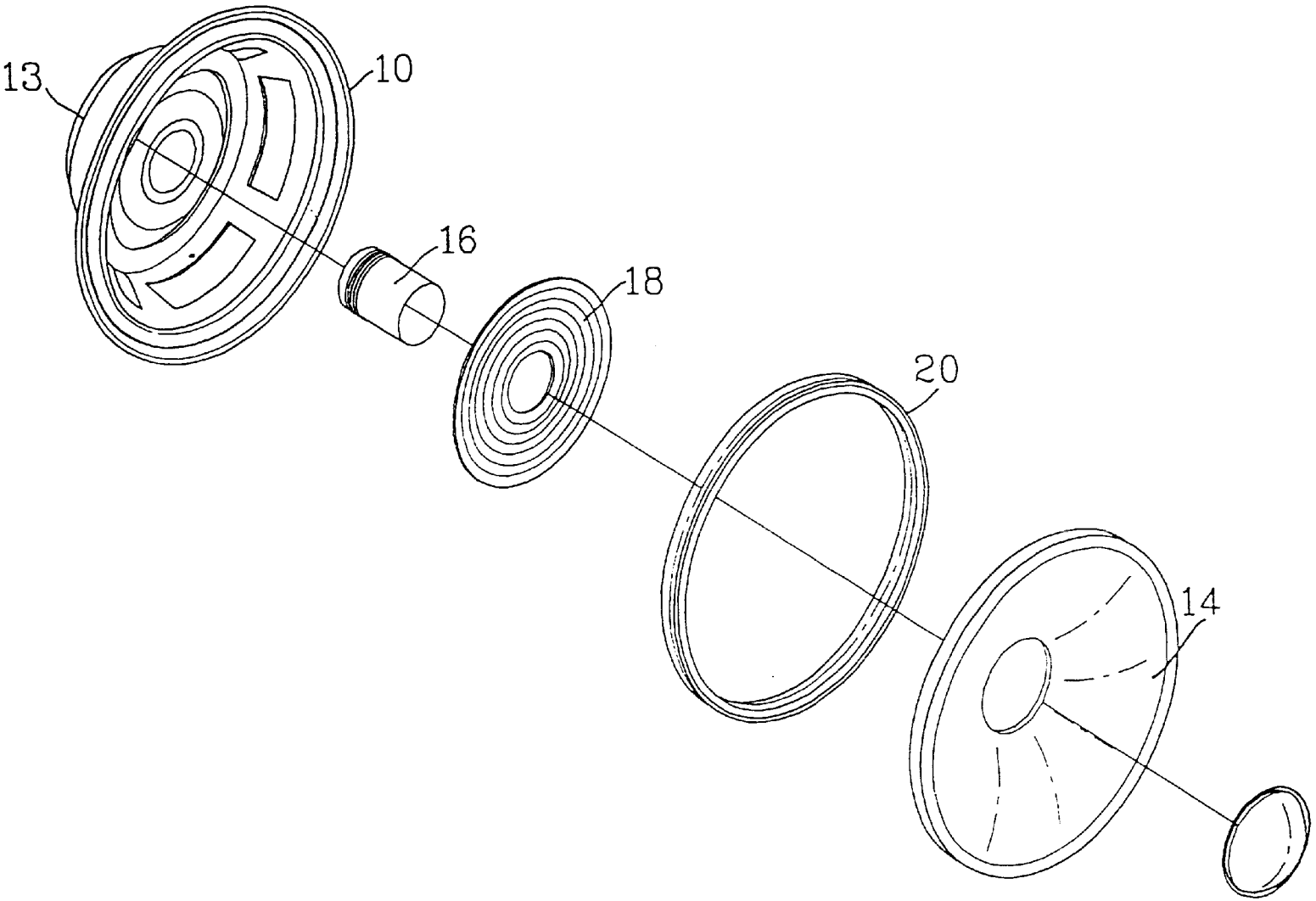
FIG. 2 is an exploded perspective view of the embodiment in the present invention.
Figures 3, 3A:
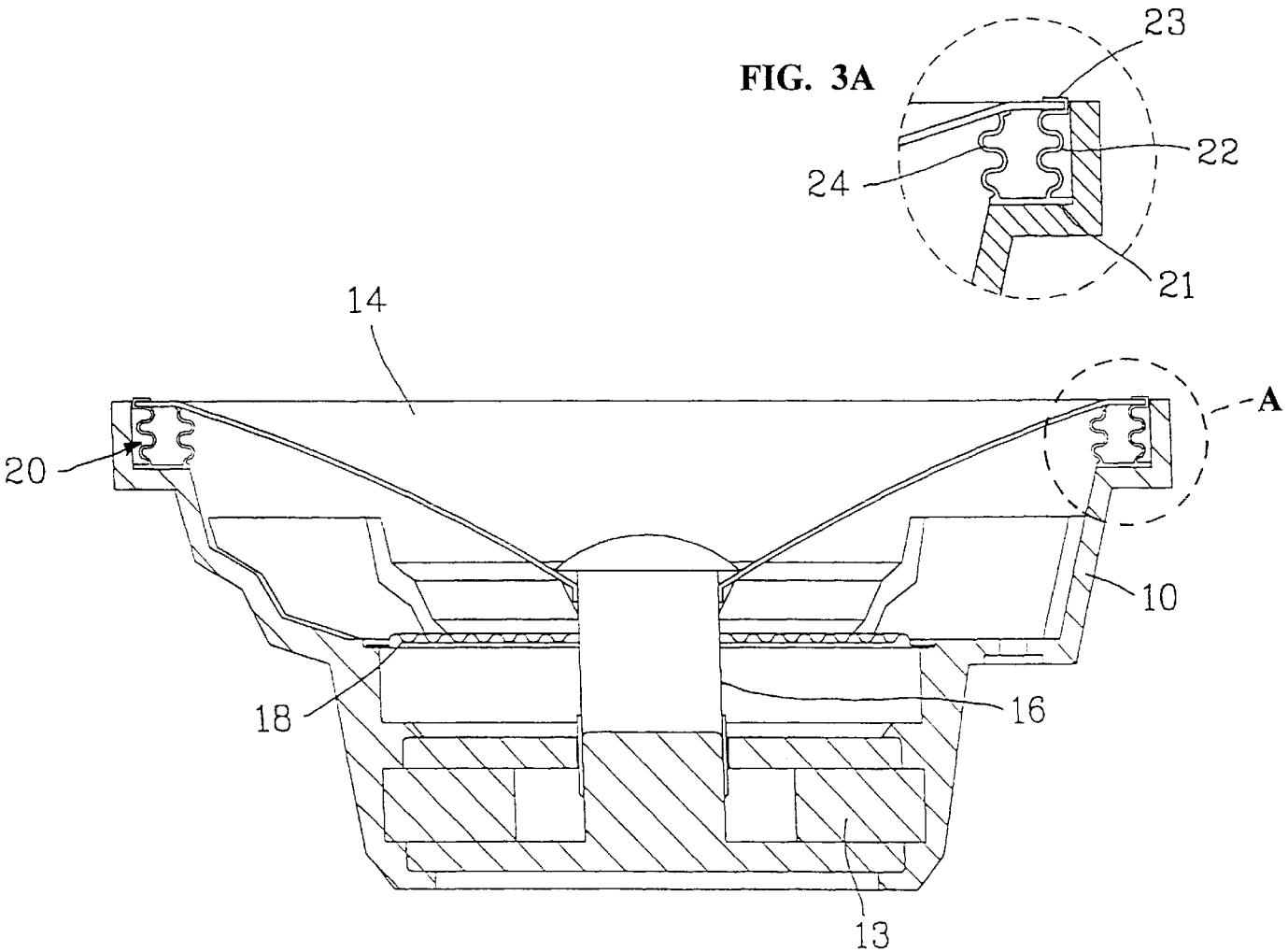
FIG. 3 is an assembled plane view of the embodiment in the present invention.
FIG. 3A is an enlarged view of area A in FIG. 3.

With reference to FIGS. 2, 3, the yoke portion structure of a speaker diaphragm of the present invention is illustrated. The speaker has a structure including following components.

A casing 10 has a front side being installed with an enlarged opening and rear side thereof is installed with a magnetic element 13.

A coil 16 is placed in the magnetic element 13.

A damper 18 is engaged with the coil 16.

A diaphragm 14 is placed at an enlarged opening of the casing 10 and is sticky to the coil.

Figures 4, 4A:
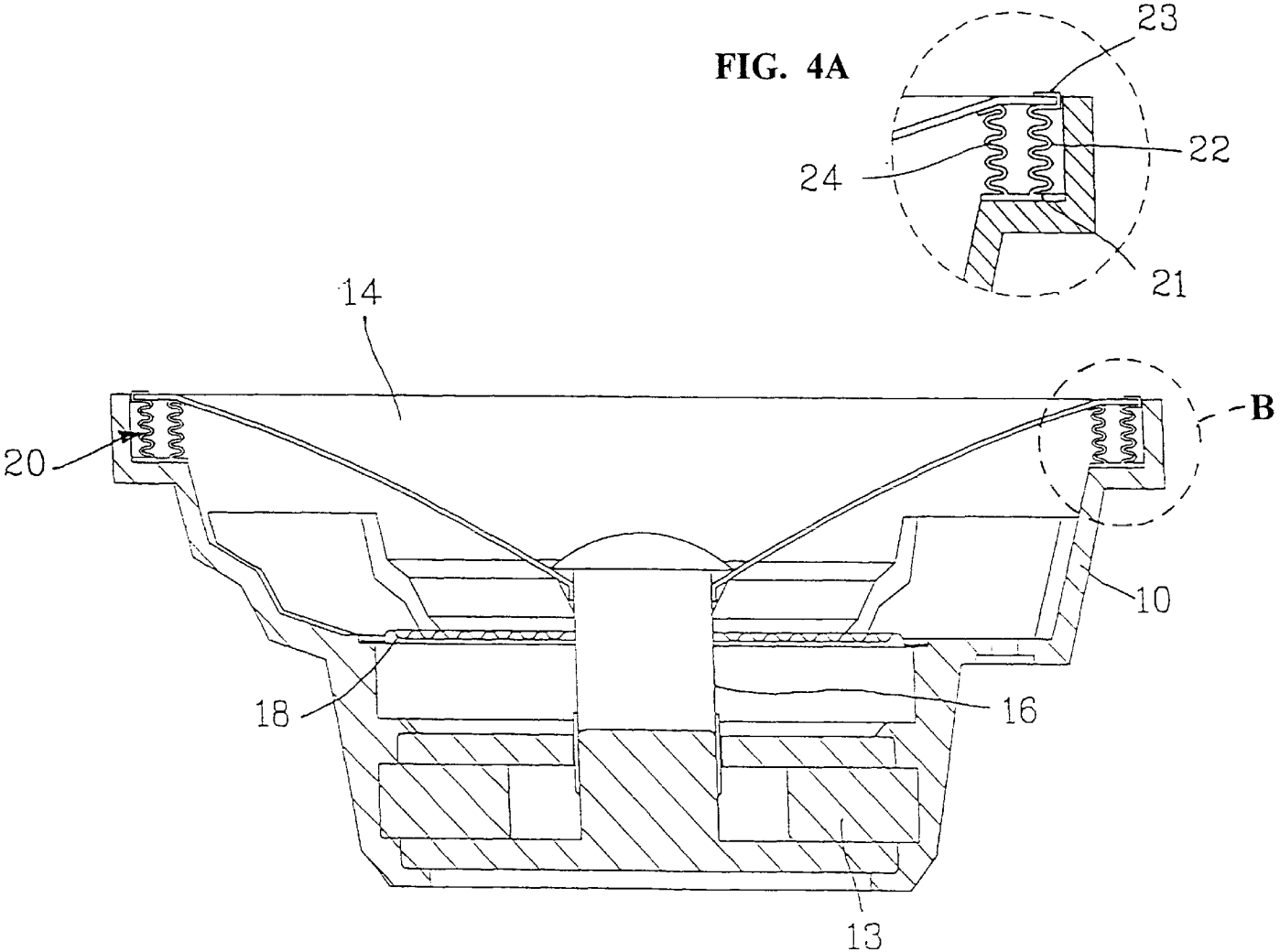
FIG. 4 is an assembled plane view of another embodiment in the present invention.
FIG. 4A is an enlarged view of area B in FIG. 4.

The feature of the present invention is that a yoke portion 20 with two layer curved portions is placed between the casing 10 and the diaphragm 14. The yoke portion is made of elastic material and has a front and a rear layer, and the upper and lower sides are formed with bent arcs. The yoke portion 20 has proper plane seat 21. The upper surface of the seat 21 is equally spaced with two curved portions 22, which are the first curved portion 22 and the second curved portion 24. The top of the first curved portion 22 is further installed with a folding edge 23. The two curved portions 22, 24 are formed with elastic curved arcs longitudinally for generating a push-pull effect in application. The two curved portions 22 and 24 have curved arcs with different numbers, as shown in FIGS. 3 and 4. In arrangement, the peak of one curved portion is correspondent to the valley of other curved portion.

Thereby, as shown in FIG. 3, in manufacturing a speaker, the seat 21 at the bottom of the yoke portion 20 is connected to the stepped portion of the casing 10 of the speaker. The tops of the second curved portion 24 resists against the bottom of the diaphragm 14. The folding edge 23 of the top of the first curved portion 22 is connected and enclosed by the end portion of the diaphragm 14 so that the diaphragm 14 can be assembled conveniently at one time and is adhered well. Moreover, the center thereof can be positioned preferably. After the diaphragm 14 is adhered, the edge can be well packaged without separation easily.

Figure 5:
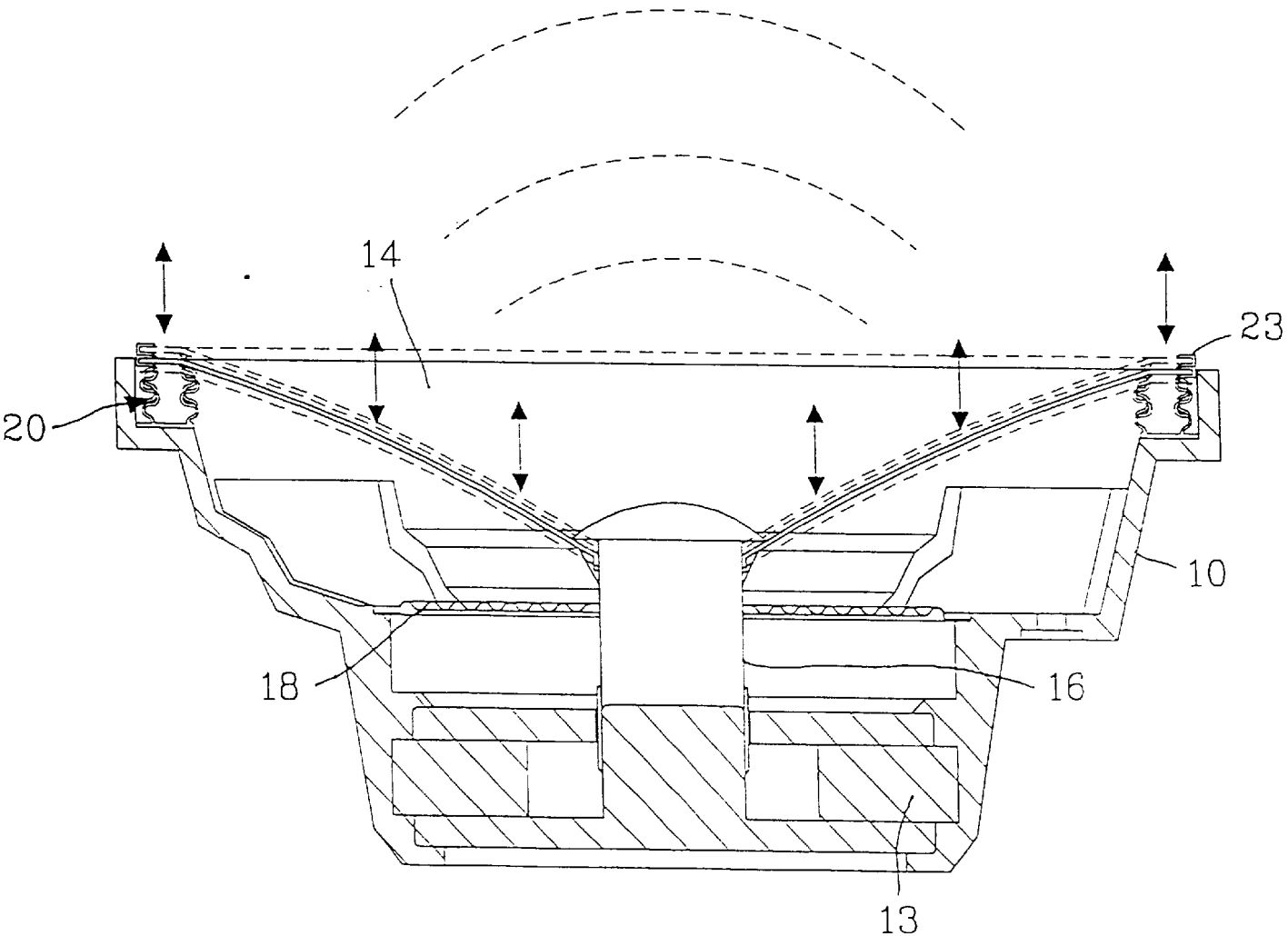
FIG. 5 is a schematic view showing the action of the vibration output in the present invention.

Referring to FIG. 5, by aforesaid structure, the yoke portion 20 are adaptive to vibration. The diaphragm 14 may move two dimensionally (leftwards or rightwards, or upwards or downwards). When speaker emits sound, the coil 16 moves forwards and the rearwards (like the movement of a piston). The two curved portions of the yoke portion 20 may properly bends so as to present a good elasticity. Therefore, as the piston moves forwards or rearwards, no large restoring force generates. Thus, the output of the speaker will avoid interference from the vibration of the diaphragm 14. Therefore, the work of the yoke portion 20 and the sound wave are more harmonic and as a result, a better sound quality is acquired.

The present invention are thus described, it will be obvious that the same may be varied in many ways. Such variations are not to be regarded as a departure from the spirit and scope of the present invention, and all such modification as would be obvious to one skilled in the art to intended to be included within the scope of the following claims.

What is claimed is:

1. A yoke for a speaker including a casing having a front side with an enlarged opening and a rear side having a magnetic element, a coil movably located in the magnetic element, a diaphragm having an inner portion attached to the coil and an outer edge portion, and a damper extending between the coil and the casing, the yoke comprising:

a) a seat portion in contact with the casing; and, b) inner and outer wall portions spaced apart from each other and extending upwardly from the seat portion, each wall portion having a serpentine cross-sectional configuration, the outer wall portion having a folding edge engaging both opposite sides of the outer edge portion of the diaphragm.

2. The yoke for a speaker of claim 1 wherein the folding edge has a U-shaped cross-sectional configuration.

* * * * *